United States Patent [19]

Henley et al.

[11] Patent Number: 4,578,909

[45] Date of Patent: Apr. 1, 1986

[54] INSULATED BUILDING CONSTRUCTION

[75] Inventors: Harold B. Henley; Kenneth L. Norberg; John P. Devine, all of Watertown, S. Dak.

[73] Assignee: Enercept, Inc., Watertown, S. Dak.

[21] Appl. No.: 454,543

[22] Filed: Dec. 30, 1982

[51] Int. Cl.[4] ..... E04B 7/02

[52] U.S. Cl. ..... 52/90; 52/92; 52/241; 52/404; 52/730; 52/275; 52/293; 52/210; 52/309.11

[58] Field of Search ..... 52/90, 92, 276, 275, 52/293, 274, 404, 309.9, 309.11, 730, 210, 241, 665

[56] References Cited

U.S. PATENT DOCUMENTS

| | | | |
|---|---|---|---|
| 1,608,324 | 11/1926 | Knox . | |
| 1,709,035 | 4/1929 | Payne . | |
| 2,029,352 | 2/1936 | Beckwith . | |
| 2,396,828 | 3/1946 | Carpenter | 52/92 |
| 3,111,787 | 11/1963 | Chamberlain . | |
| 3,113,401 | 12/1963 | Rose . | |
| 3,203,145 | 8/1965 | Raynes . | |
| 3,300,919 | 1/1967 | Hiller . | |
| 3,376,678 | 4/1968 | Thygeson . | |
| 3,423,898 | 1/1969 | Tracy et al. | 52/665 X |
| 3,583,118 | 6/1969 | Lowery . | |
| 3,641,720 | 2/1972 | Berrie . | |
| 3,665,662 | 5/1972 | Timbrook et al. | 52/92 X |
| 3,775,921 | 12/1973 | Avera . | |
| 3,783,174 | 1/1974 | Lindgren . | |
| 3,877,194 | 4/1975 | Matuschek et al. | 52/730 |
| 3,881,292 | 5/1975 | Porter . | |
| 3,922,828 | 12/1975 | Patton . | |
| 4,114,333 | 10/1978 | Jones et al. . | |
| 4,129,970 | 12/1978 | Whitney . | |
| 4,161,087 | 7/1979 | Levesque . | |
| 4,163,349 | 8/1979 | Smith | 52/241 |
| 4,224,774 | 9/1980 | Petersen | 52/404 |
| 4,423,487 | 10/1980 | St. Clair . | |

*Primary Examiner*—Donald G. Kelly
*Assistant Examiner*—Creighton Smith
*Attorney, Agent, or Firm*—Merchant, Gould, Smith, Edell, Welter & Schmidt

[57] ABSTRACT

The present invention is directed to an insulated building construction which includes panels having interior and exterior skins with an insulating core therebetween. Additionally, the bearing posts between panels have interior and exterior support members with an insulating layer therebetween. A mechanism for maintaining a thermal barrier around corners as well as between walls and roof is disclosed. All panels have standardized passageways which mate with one another to provide an efficient way of routing electrical wiring. A building in accordance with this invention may be constructed to be completely surrounded by appropriate insulating material thereby minimizing "thermal shorts".

16 Claims, 27 Drawing Figures

34
94
177
86
60
56
58
48
88
170
2F

INSULATED BUILDING CONSTRUCTION

FIELD OF THE INVENTION

This invention relates to a building construction and, more particularly, to a construction utilizing prefabricated, modular insulated panels in conjunction with items such as stud posts, which maintain an insulation barrier along a wall and fastening mechanisms which provide for minimization of thermal shorts from the exterior of the building to the interior.

BACKGROUND OF THE INVENTION

It has long been recognized that buildings stay warmer in cool climates and cooler in warm climates when certain materials having thermal insulating properties are used in the walls, ceiling and floor of the building. It is common practice to build the frame of a building, attach one wall, and then fasten an insulative material to the first wall and frame before attaching the second wall thereby sandwiching the insulative material. When various energy sources became more and more scarce, it became more and more common to increase the distance between the walls and also increase the amount of insulative material therebetween. As construction costs increased, it became more common for builders to rely on prefabricated components.

A number of patents show various types of building constructions which use various prefabricated, insulated panels. U.S. Pat. No. 3,203,145 is illustrative of a prefabricated, modular home construction. Panels having interior and exterior skins with a central core of insulation material are shown. In addition, there is disclosure of formed metallic mechanism for attaching the panels to a cement slab floor and formed metallic mechanism for attaching the wall panels to roof panels. The roof panels are shown to come together at a central metal beam in order to provide a vaulted ceiling.

U.S. Pat. No. 3,641,720 shows a prefabricated building with interfitting stud splines. Prefabricated panels with outer skins and an insulating filler have edges in the form of metal sockets to receive box-type, metal stud splines. In some cases, the wall panels wrap sufficiently about the stud splines so that some insulation is located on all sides of the stud spline. As well as providing structural strength, the stud splines also form conduits for electrical wiring. Additionally, a formed metallic mechanism for attaching roof panels is shown.

U.S. Pat. No. 4,163,349 also discloses insulated building panels with interior and exterior skins and an insulated core. A corner construction more applicable to the usual frame house is shown. A square wood stud is received between the exterior and interior skins at a vertical edge of a corner panel. A second rectangular stud is attached adjacent the corner to the interior skin. The mating corner panel from a second wall receives the second stud between its interior and exterior skins such that the interior skin butts against the interior skin of the first panel and the exterior skin reaches across to cover both studs and butt against the exterior skin of the first panel.

Despite these and other various attempts of builders, construction engineers, and inventors to enhance the thermal properties of a building construction, there continues to be substantial cost and performance considerations. Most constructions have, for example, a number of areas which qualify as "thermal shorts". That is, most of a wall or panel is well insulated; however, an adjacent element includes a path having good thermal conduction characteristics or includes a crack allowing a convection current to pass through which in either case provides for the passage of heat. For example, both U.S. Pat. No. 3,641,720 and U.S. Pat. No. 3,203,145 utilize various metal structural components which include cavities. Metal has very good thermal conduction characteristics and, consequently, is a "thermal short". The various cavities provide excellent channels for convection currents. Furthermore, the ordinarily large number of metal components around the walls and ceiling of a building creates a large number of "thermal shorts"and, consequently, much of the cost which has gone into expensive insulated panels may well be wasted. Additionally, the various metal studs and other stuctural members are themselves very expensive. Even U.S. Pat. No. 4,163,349 which utilizes wood studs provides for greater thermal conduction across the wood stud than is otherwise the case through the insulated panel. Thus, a certain pressure continues within the industry to provide building construction having better thermal characteristics while maintaining or reducing cost.

SUMMARY OF THE INVENTION

The present invention is directed to a building construction having walls, floor, roof and mechanism for joining them. The walls, for example, include panels having interior and exterior skins with an insulating core fastened between the skins. A mechanism for bearing a load, such as a roof, includes a post made from interior and exterior support members with an insulating layer therebetween. The post is fastened between adjacent panels such that the insulating layer is aligned with the insulating cores of the panels. Such alignment advantageously provides a continuous thermal insulation barrier from one panel to another across said post. In this fashion, the heretofore previously present "thermal short" of a stud or other connective member is eliminated.

Each panel of the present building construction includes a horizontal passageway through the insulating core at an approximate height of the bottom of electrical outlet boxes, a height which is commonly dictated by building codes. Furthermore, the bearing post includes a similar passageway at a similar height. In this way, electrical wiring may be routed along a wall between various outlet boxes. It is further advantageous for each panel to include a vertical passageway in the insulating core extending from the bottom of the panel to the horizontal passageway. This allows for the routing of the electrical wiring into the basement and for running between various walls.

Further flexibility in wiring the present building construction is possible by providing a groove along the vertical edge of panels adjacent to one or both sides of a door. Such grooves may extend from the floor to the ceiling thereby allowing switch boxes to be placed at an appropriate height and also providing for wiring to extend to the ceiling panels. Similar grooves are used along the edges of ceiling panels. For special design situations, an additional passage is easily bored from a groove toward the interior of any panel for placement of a light or electrical switch or outlet as desired. Thus, the present invention provides for building walls and ceilings which eliminate "thermal shorts" while yet providing for very versatile and standardized electrical wire routing.

The present building construction provides for a thermal barrier up to and around window and door frames. "Thermal shorts" are also prevented at corner joints between walls. A bearing post is received between the interior and exterior skins of one panel of a corner. An insulating strip is attached adjacent to the end of the panel for being received between the interior and exterior skins of the abutting panel of the corner. The insulating layer has greater width than the bearing post. Therefore, there exists an insulating layer about the interior sides of the bearing post which itself offers good insulating characteristics. Thus, the corner joint in combination with the various bearing posts having an insulating layer form a walled closure having essentially no "thermal shorts" but allowing for windows and doors as appropriate.

Gable panels extend above end walls. A bearing post rising from the sill plate of the first floor supports a center beam. Roof panels are advantageously fastened to one another above the center beam to thereby eliminate any "thermal short" at that joint. Additionally, the lower ends of the roof panels rest on header plates which have abutting triangular insulating strips. Thus, again, an insulation barrier is formed between the wall panels, the triangular strip and the roof panels.

In buildings having basements, panels similar to the first floor wall panels but having more structural support are used. Additionally, for buildings having a crawl space underneath the floor or where a floor is located over a garage or other open, cold space, floor panels somewhat similar to the basement wall panels having the additional structural support are used. In any case, the present building concept provides for a completely insulated enclosure.

It is apparent, therefore, that the present building construction with its many innovations for minimizing or completely eliminating "thermal shorts" significantly enhances the thermal characteristics of a structure as compared to the structures of the prior art, especially those which use metal structural members. At the same time, the present building construction is not prohibitively expensive. The present invention is truly a way for the common house buyer and builders of other buildings to participate in the national priority of conserving energy in an affordable fashion.

FIGS. *2a*, *2b* and *2c* are exploded perspective views of panel sections utilized in typical first floor construction;

FIG. *2d* is a perspective view of a typical panel used in basement construction;

FIG. *2e* is a view in top plan of the panel of FIG. *2d;*

Figure 1:
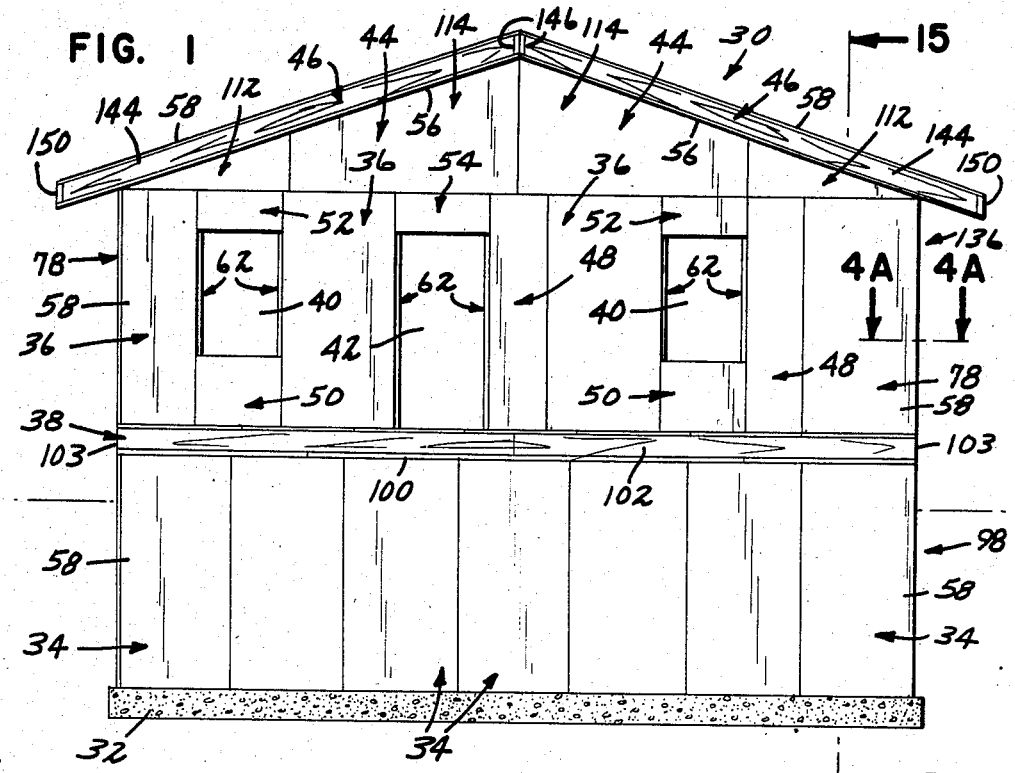
FIG. 1 is an elevational view of a partially completed building utilizing the basement, first floor, gable and roof panels of the present invention.
Figure 19:
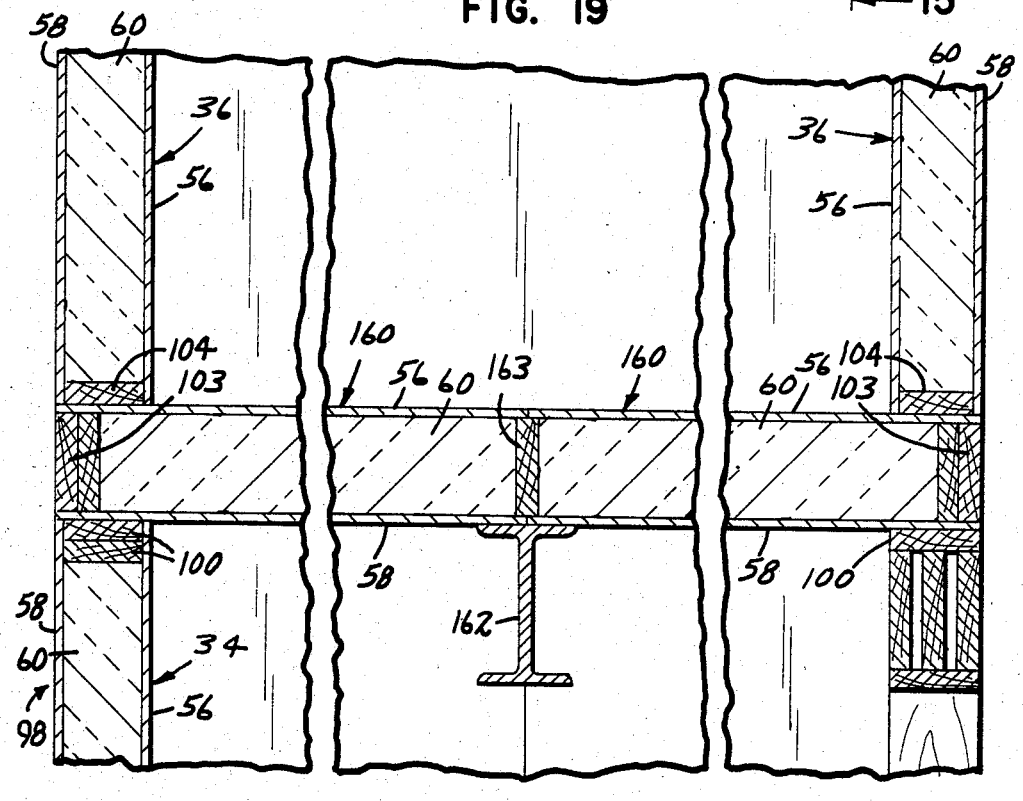
Figures 2A, 4A:
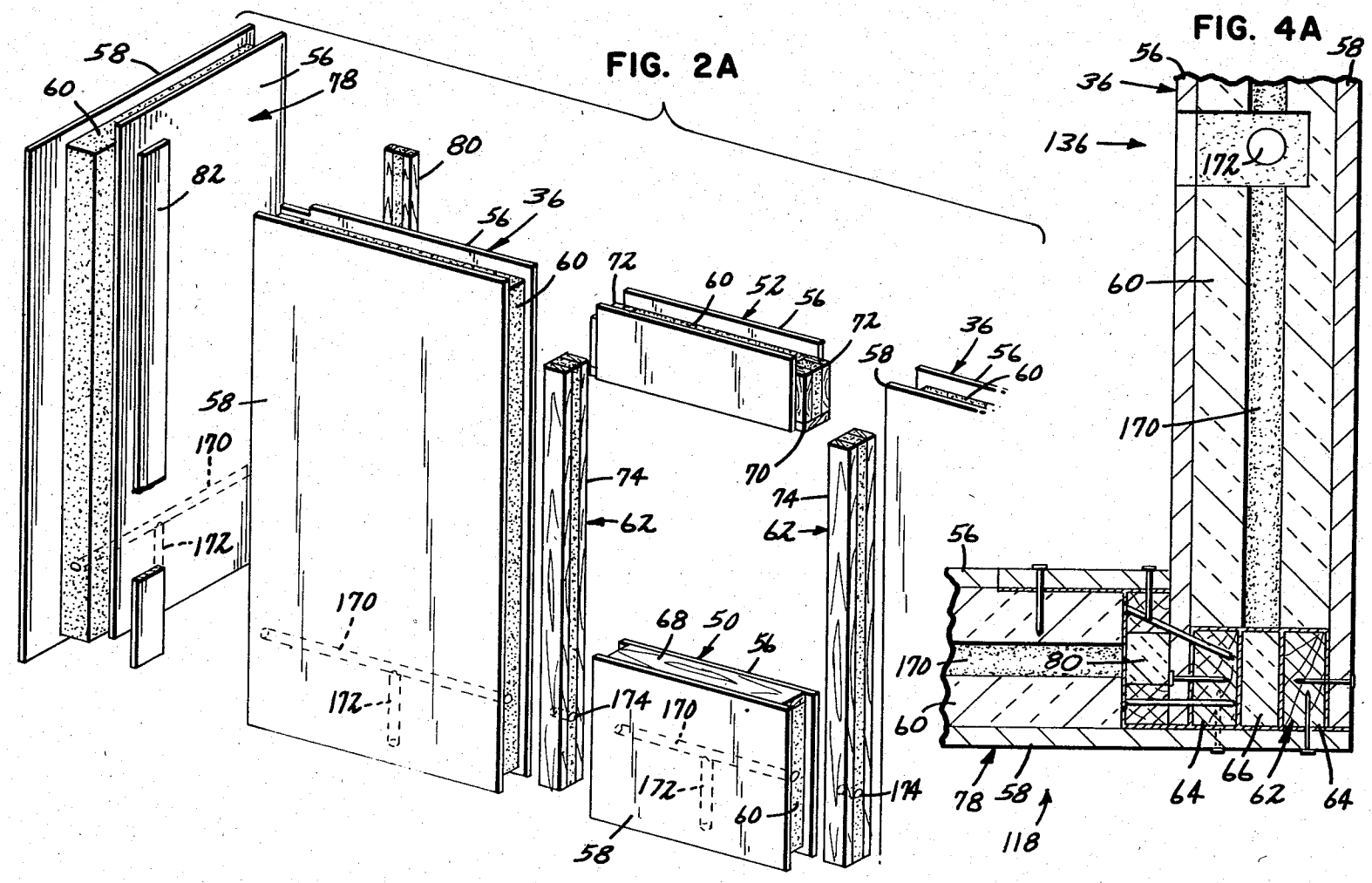
Figure 3:
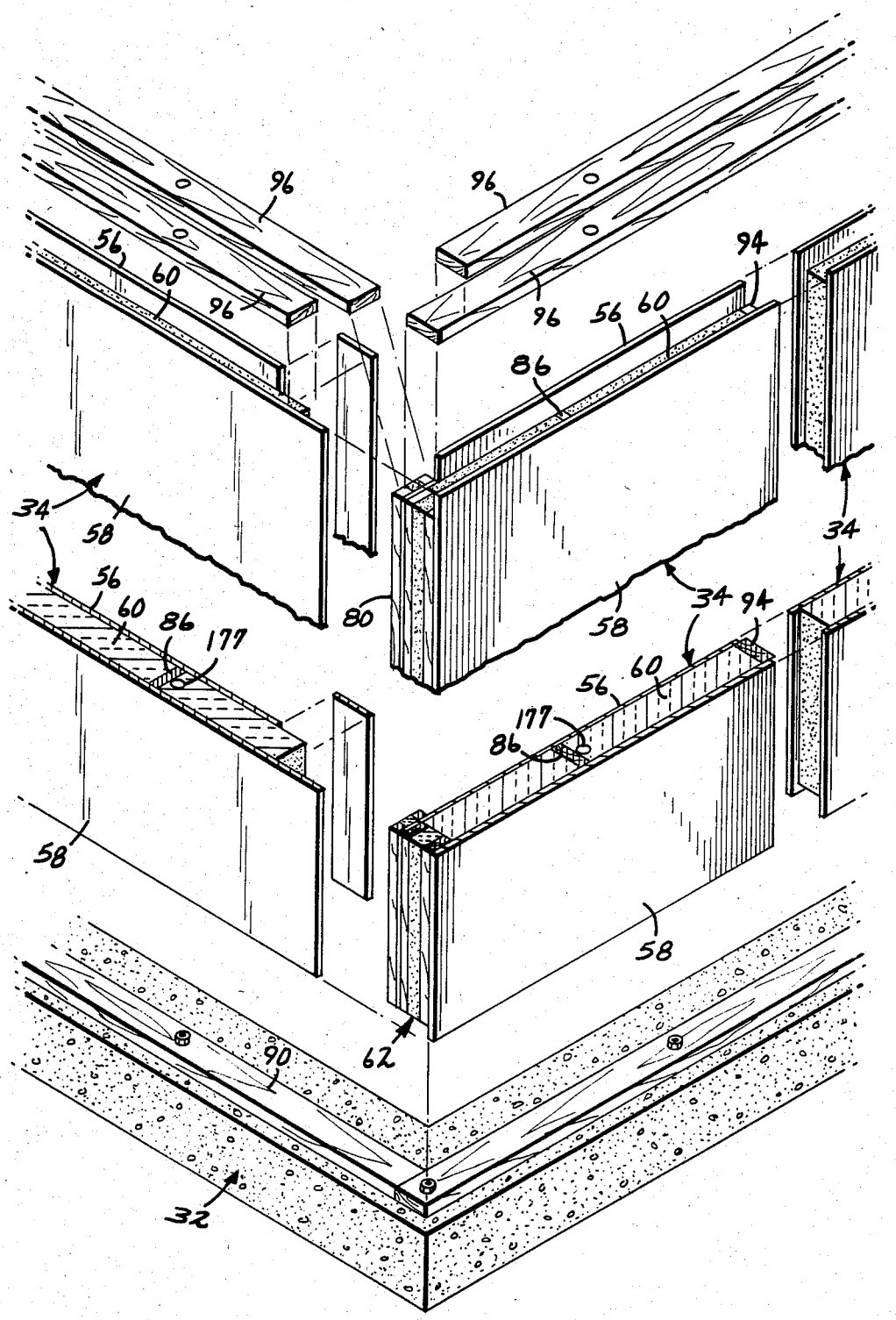
Figure 4:
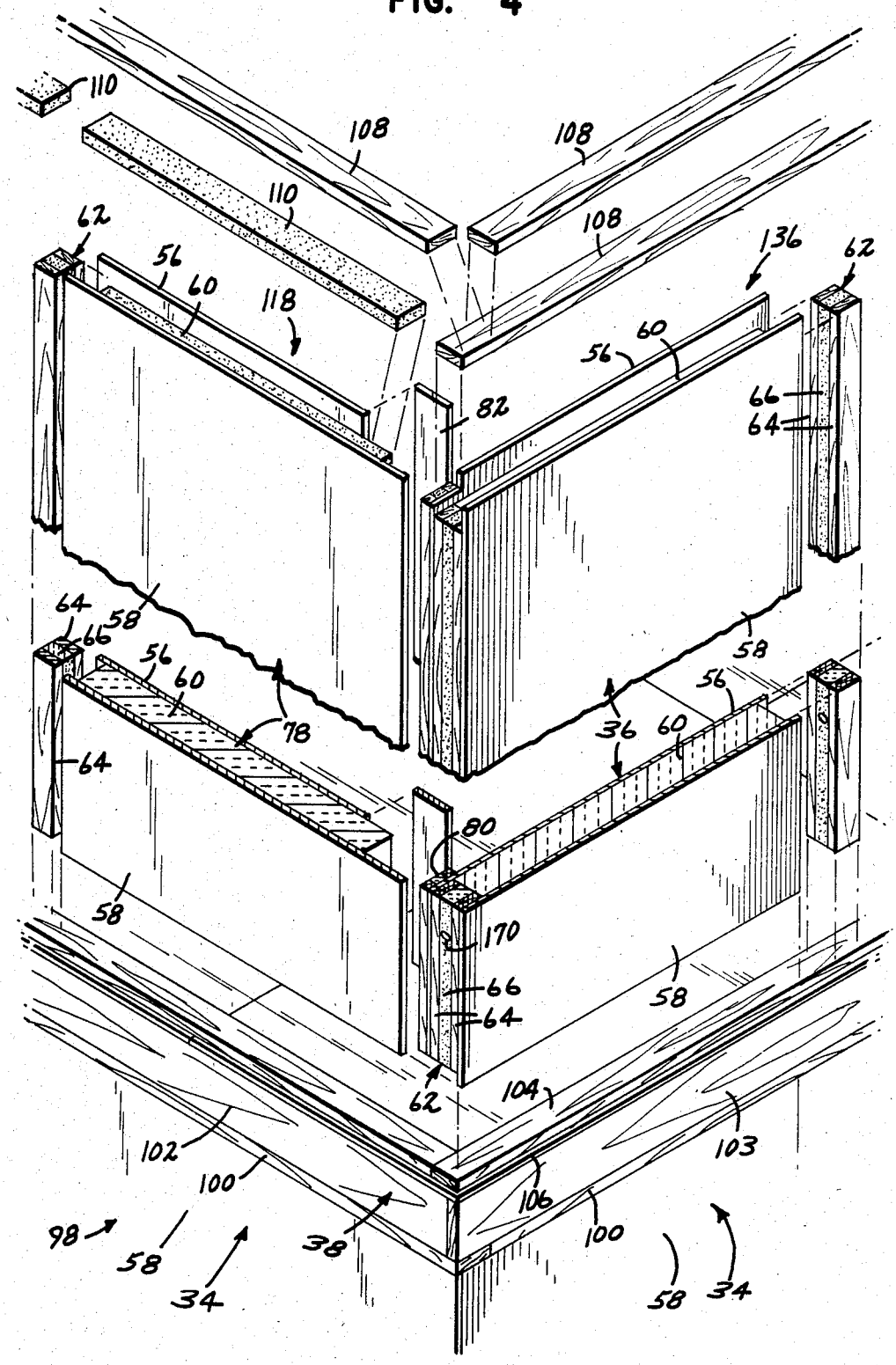
Figure 5:
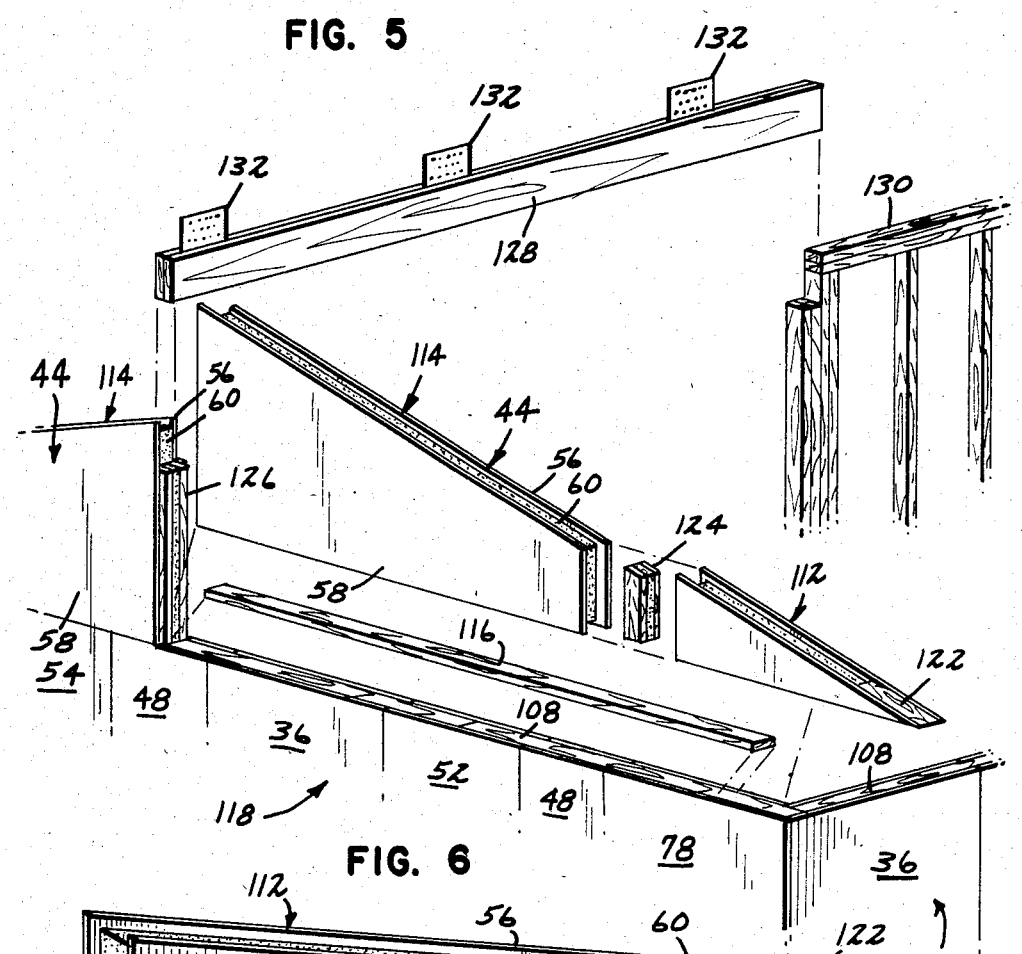
Figure 6:
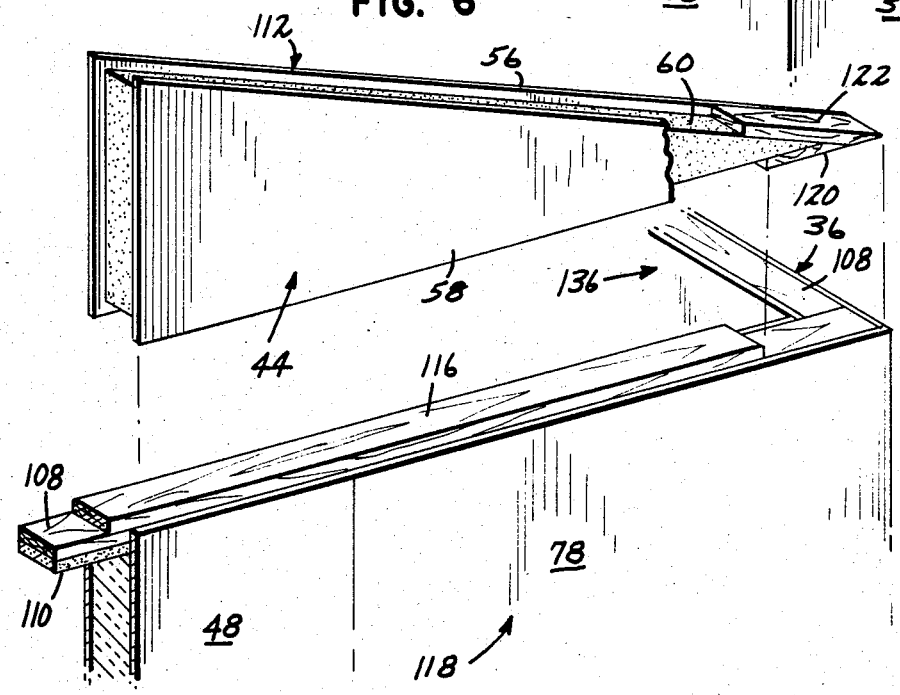
Figure 14:
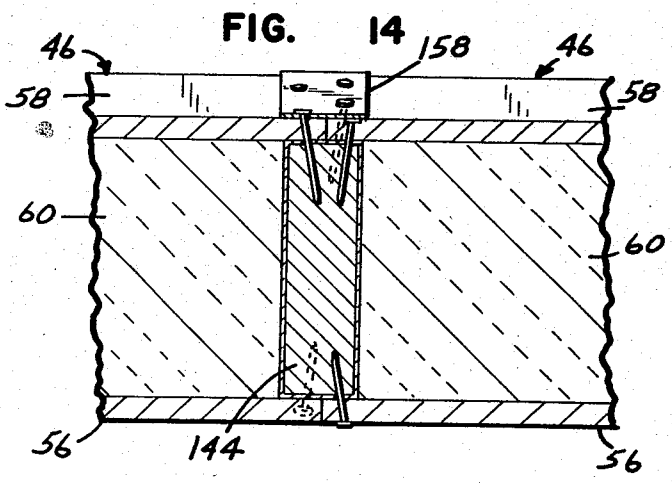
Figure 7:
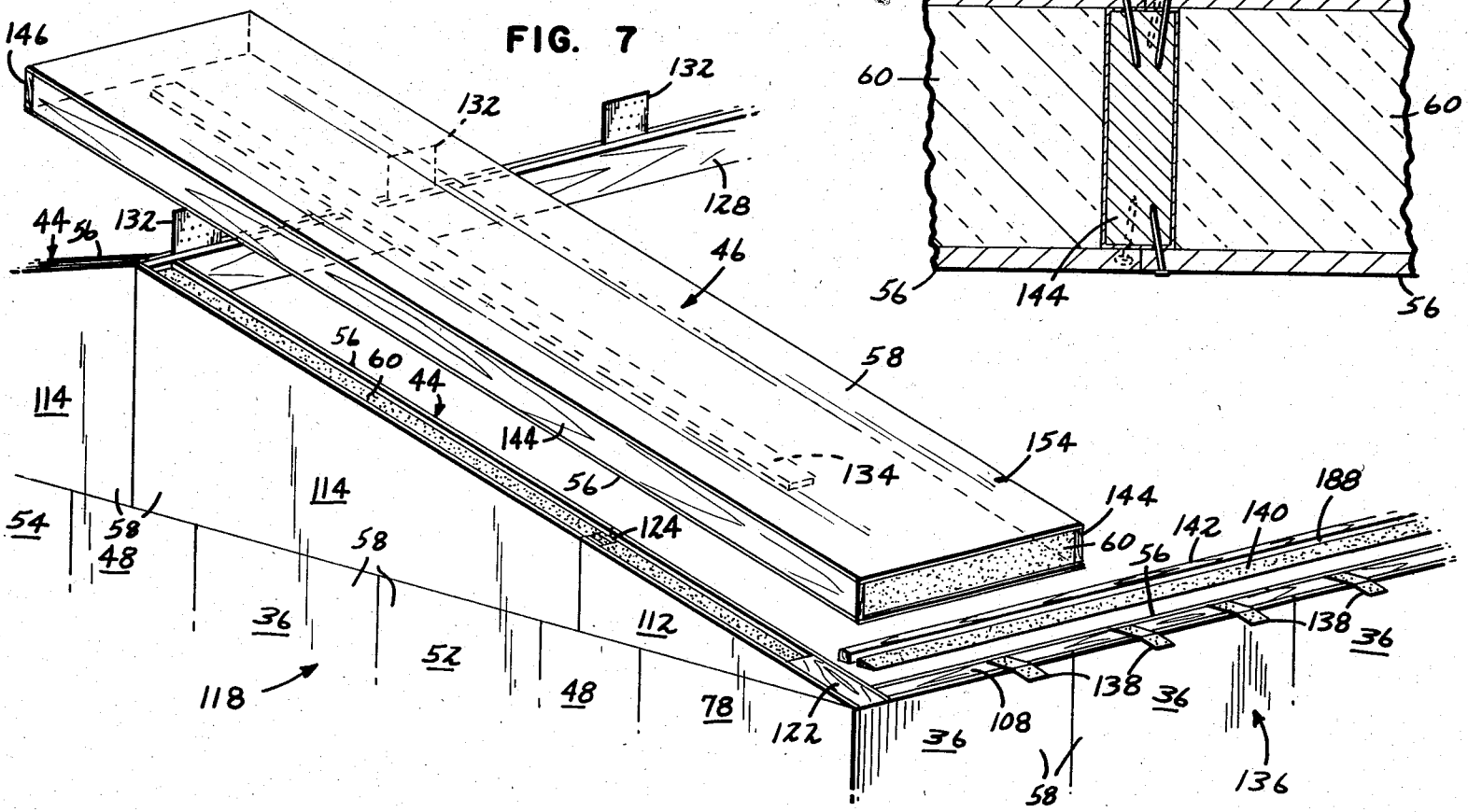
Figure 8:
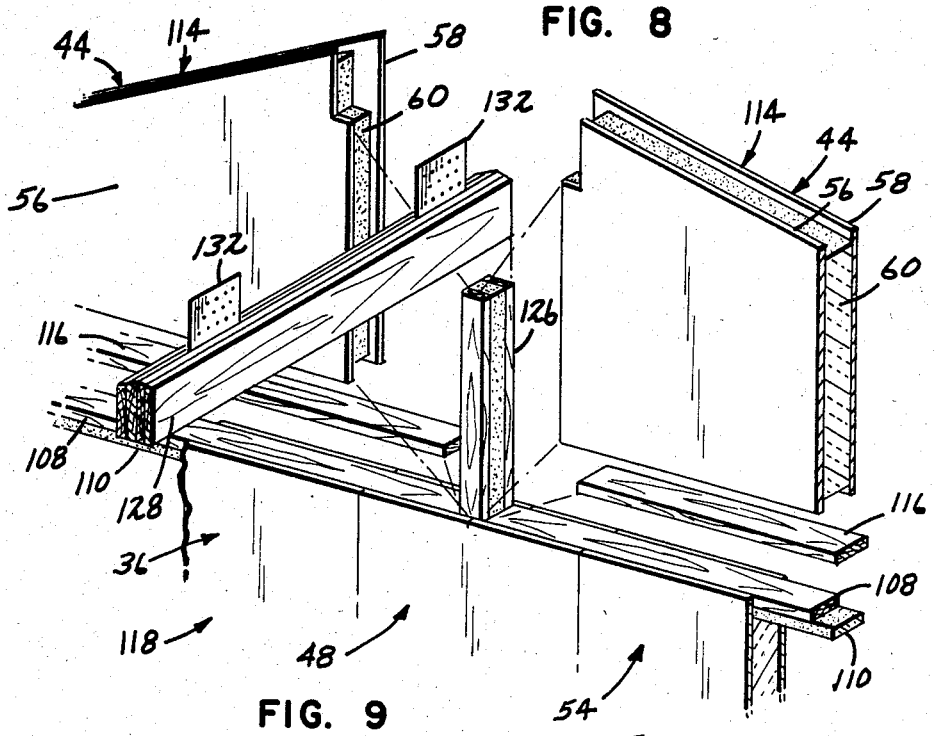
Figure 9:
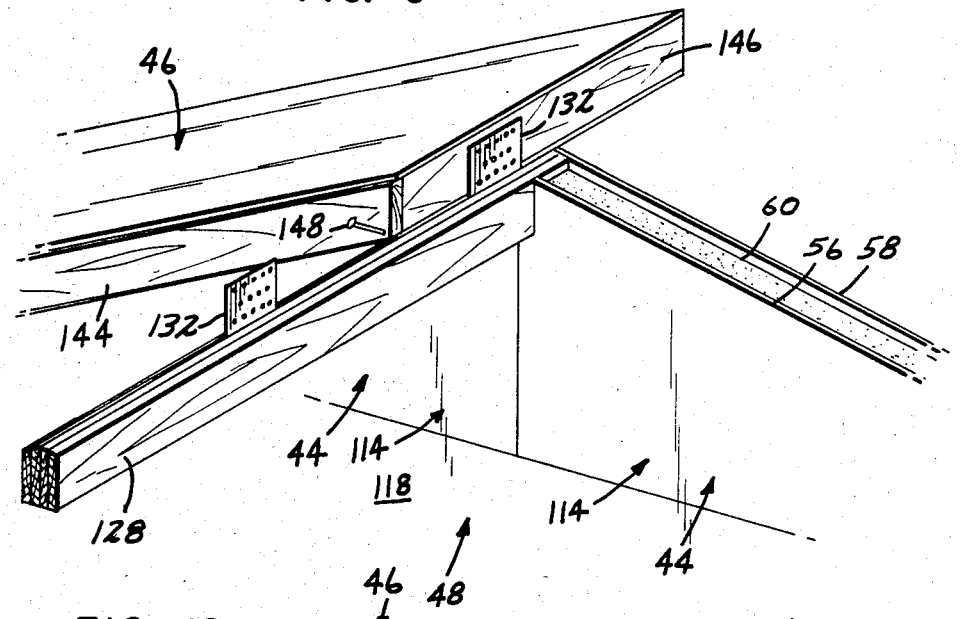
Figure 10:
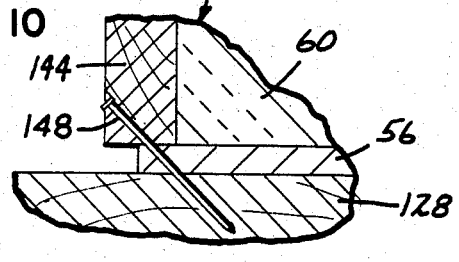
Figure 11:
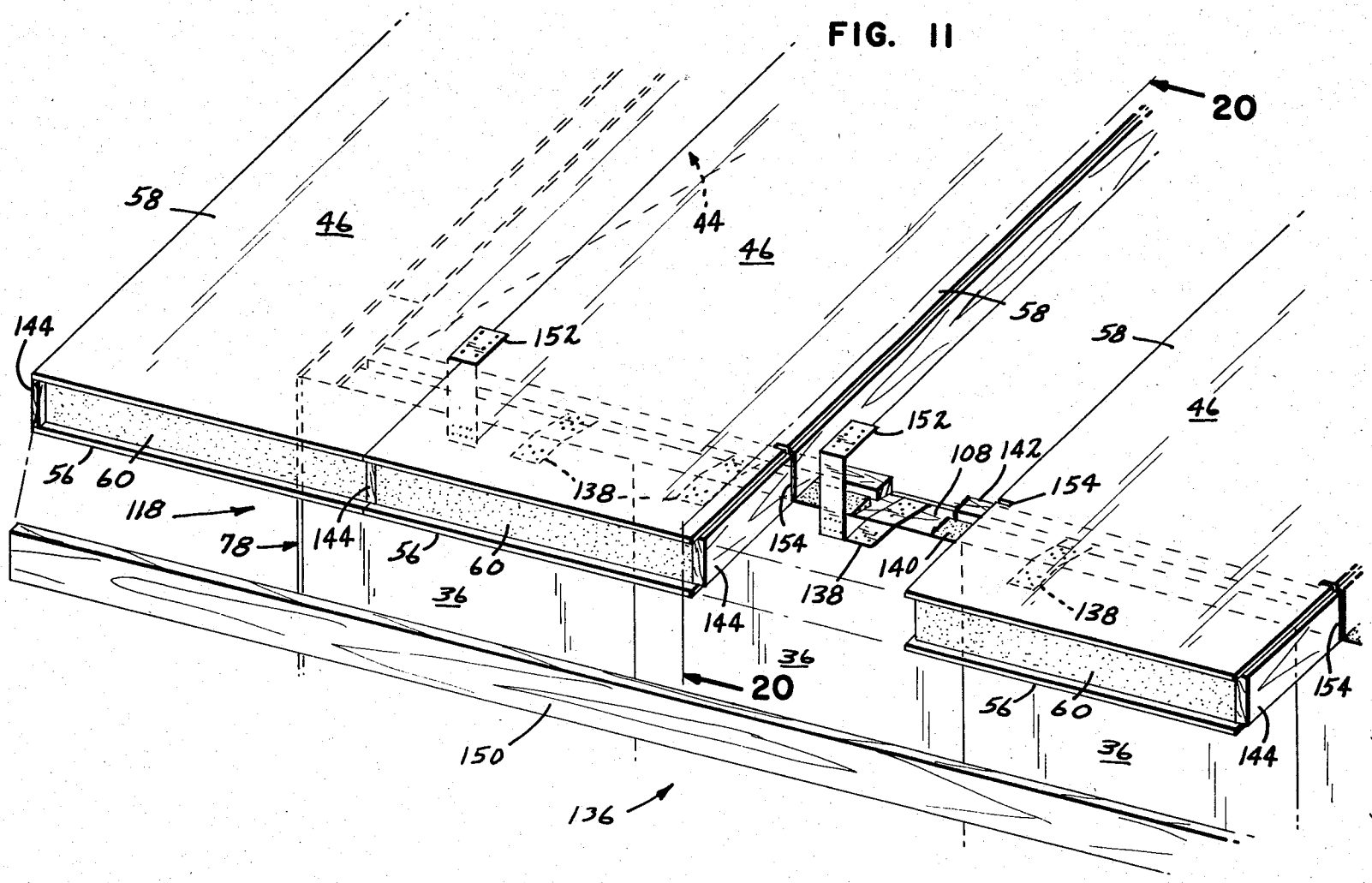
Figure 12:
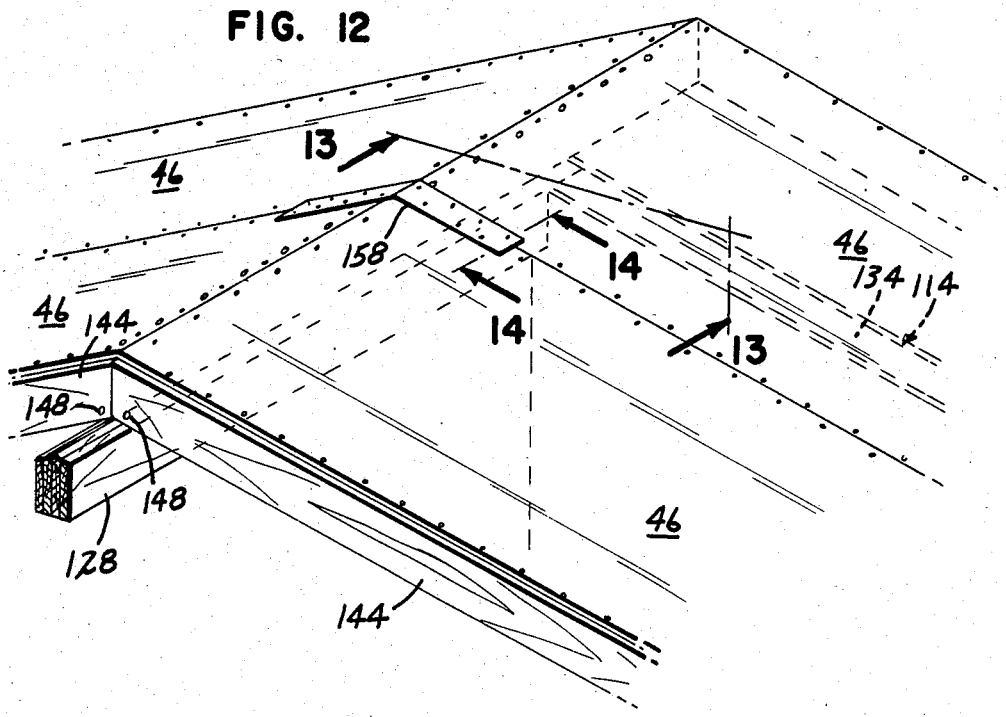
Figure 13:
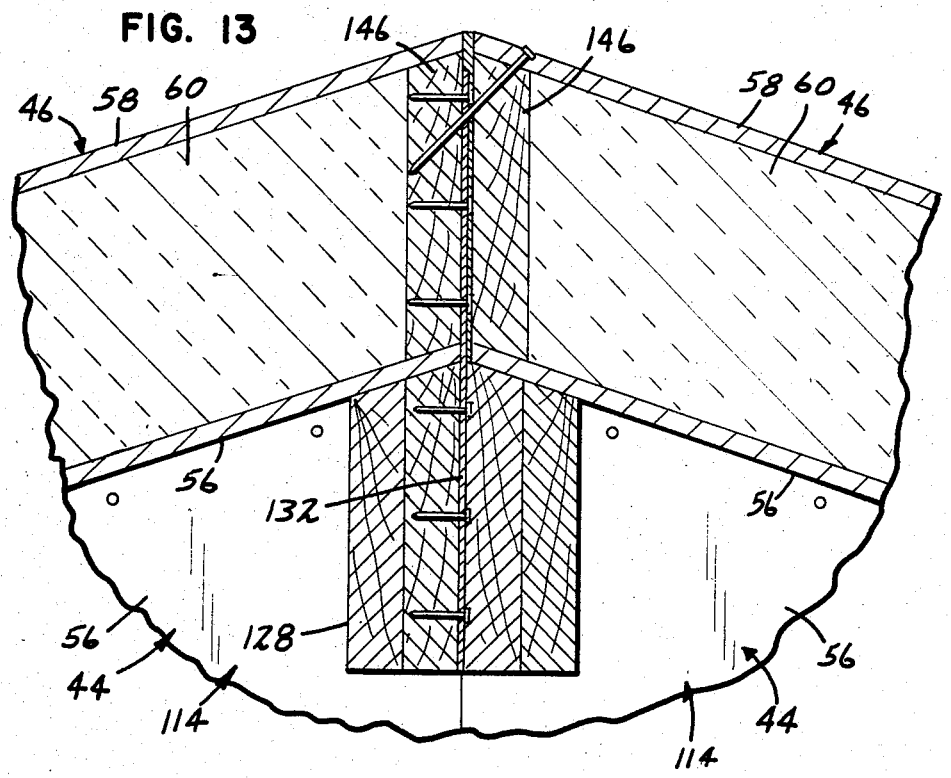
Figure 15:
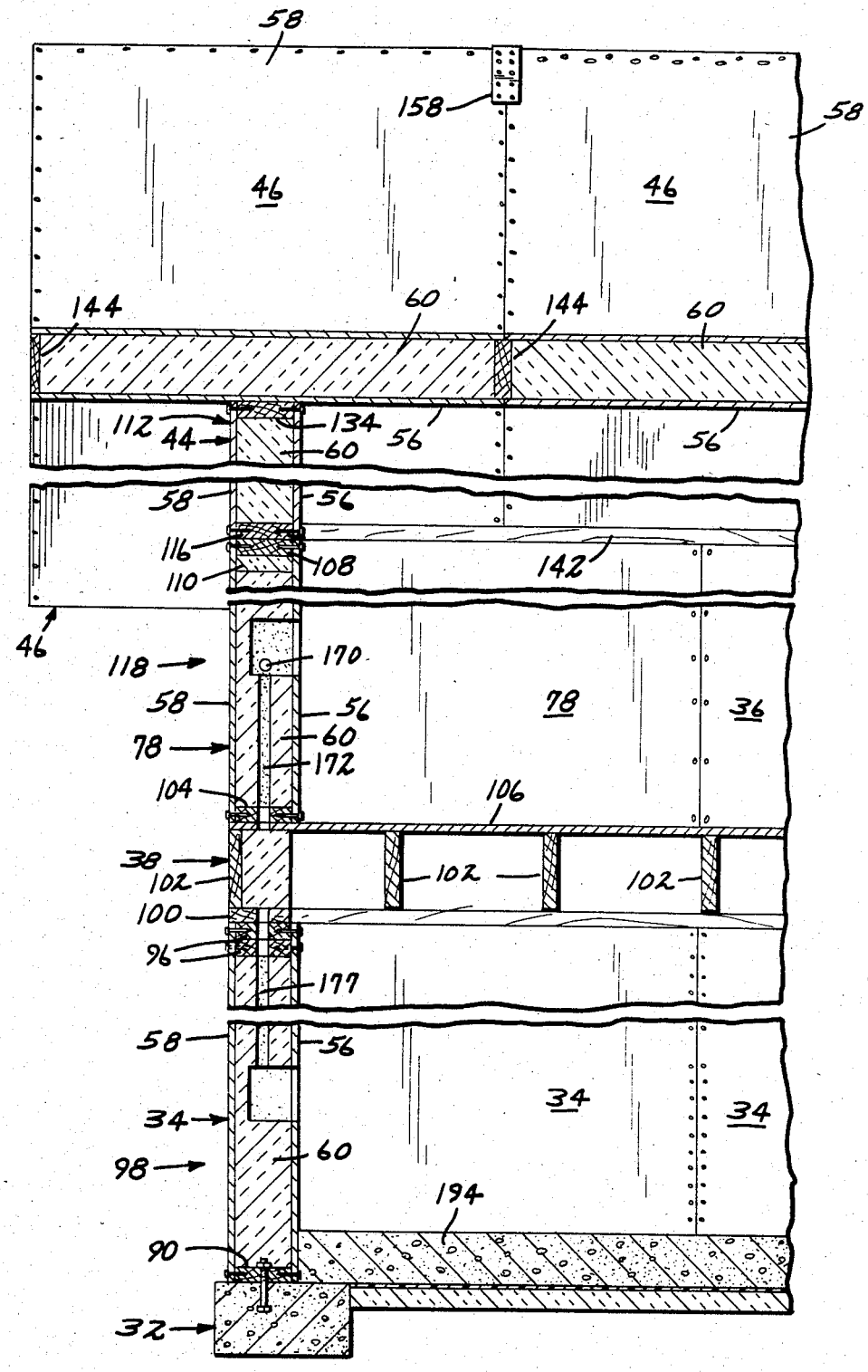
Figure 16:
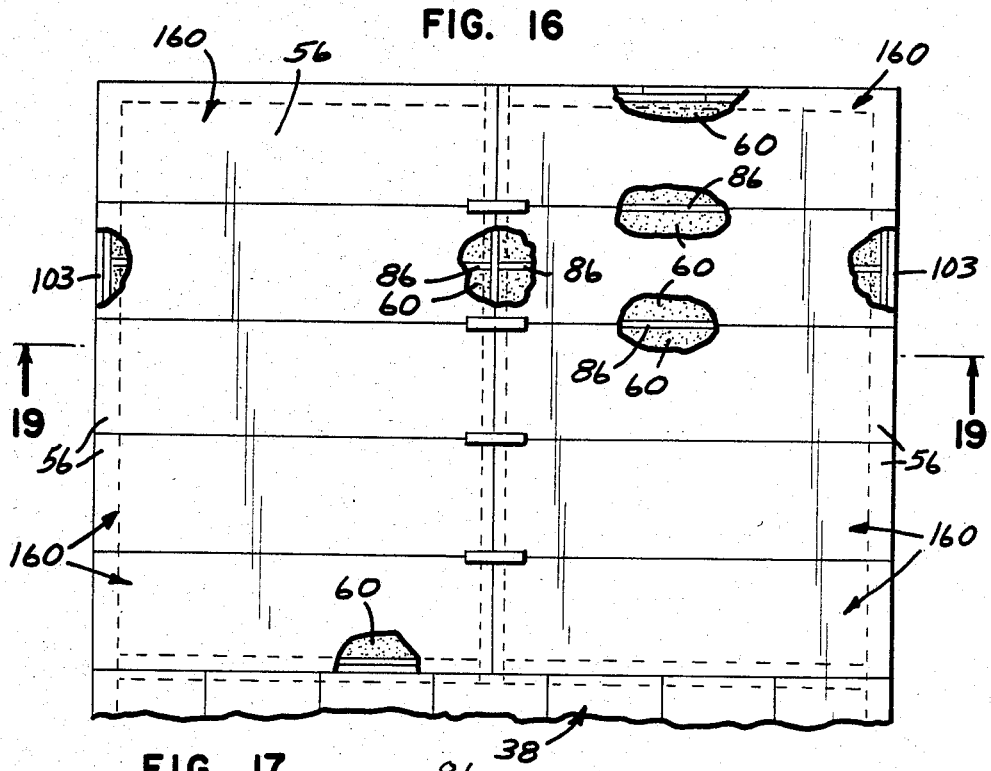
Figure 17:
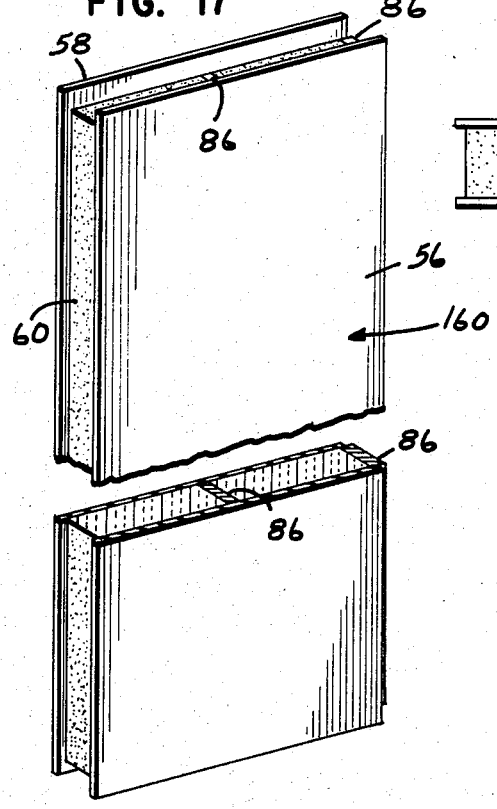
Figure 18:
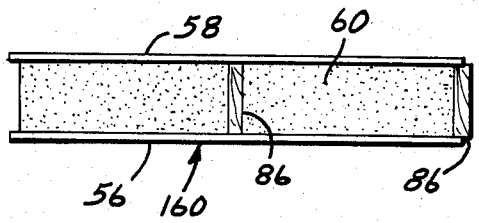
Figure 20:
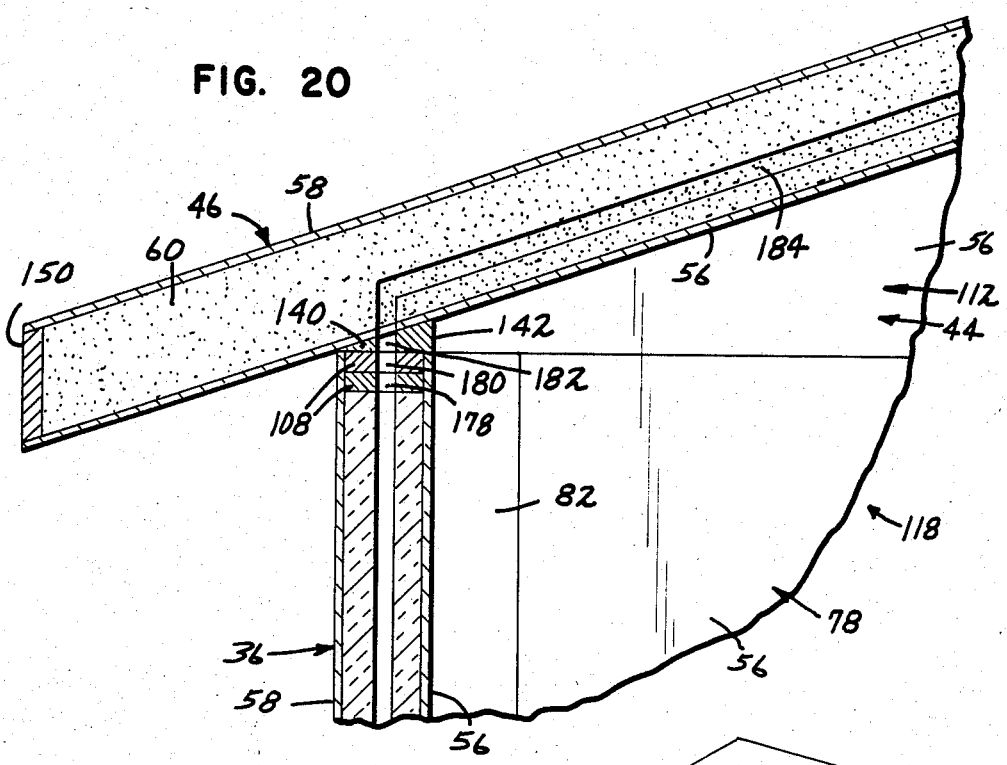
Figure 21:
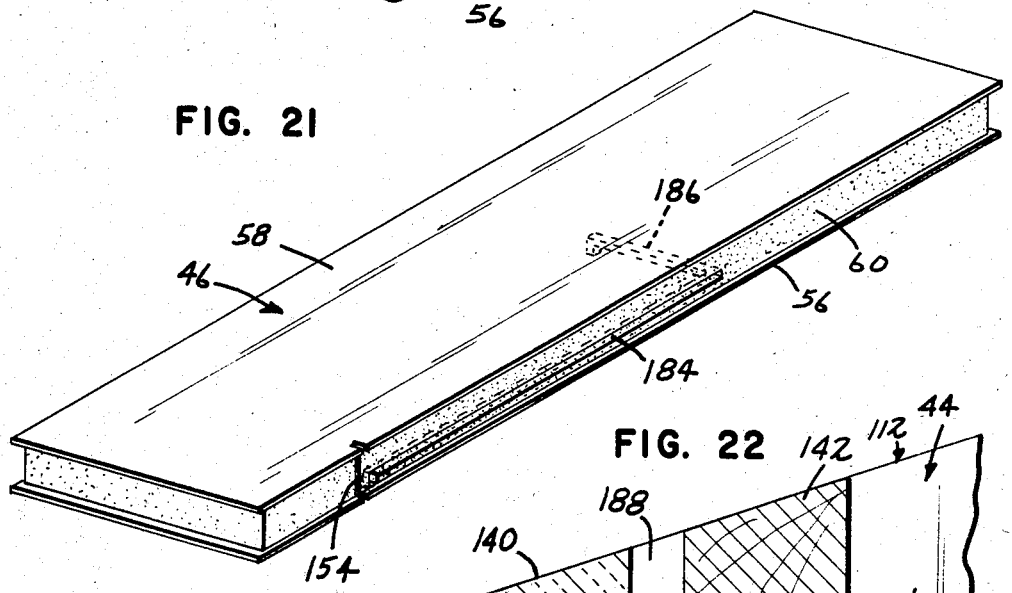
Figure 22:
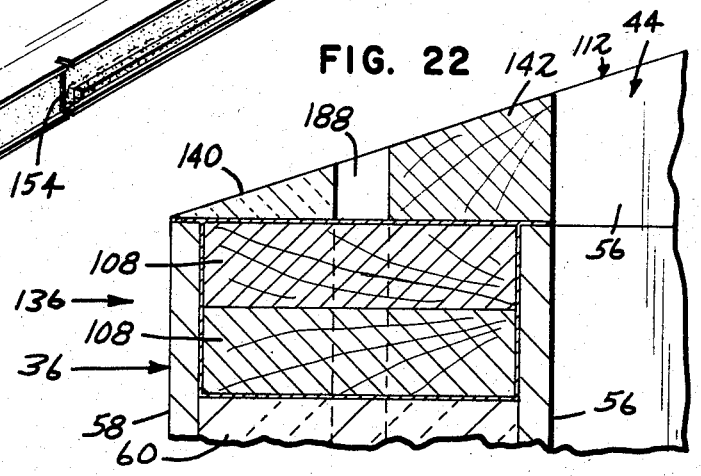

FIG. *2f* is a horizontal section as seen from the line *2f—2f* of FIG. *2c* showing the panels in an assembled condition;

FIG. 3 is an exploded view in perspective of a typical basement wall structure utilizing the panels of FIG. *2d,* portions thereof broken away and shown in section;

FIG. 4 is a fragmentary view in exploded perspective illustrating a typical corner construction of the first floor panels illustrated in FIG. *2a* (this Figure illustrates the top plate construction also);

FIG. *4a* is a horizontal section on an enlarged scale as seen generally from the line *4a—4a* of FIG. 1 illustrating the panels of FIG. 4 in their assembled condition;

FIG. 5 is an exploded perspective view of a wall with a gable panel and supporting beam;

FIG. 6 is an exploded view in perspective from a different angle showing a portion of FIG. 5;

FIG. 7 is a view in perspective of the structure of FIG. 5 with the gables and beam assembled and with the addition of a roof panel just prior to assembly;

FIG. 8 is an exploded view in perspective illustrating relative parts of gable and beam support structure;

FIG. 9 is a view in perspective of the structure of FIG. 8 in an assembled condition with the addition of roof panels;

FIG. 10 is a fragmentary detailed view in section showing a detail of nailing the roof panels to the supporting beam structure;

FIG. 11 is a view in perspective illustrating the securing of roof panel sections to supporting wall structure and each other;

FIG. 12 is a fragmentary view in perspective illustrating the adjoining of roof panels to each other and to a supporting beam structure on each side of the pitch of the roof;

FIG. 13 is an enlarged detailed sectional view as seen generally from the line 13—13 of FIG. 12 illustrating the nailing pattern for securing the roof structure of FIG. 12 to each other and to the supporting beam structure;

FIG. 14 is a detailed view in section as seen generally from the line 14—14 of FIG. 12 illustrating further securement of roof panel sections to each other;

FIG. 15 is a view in vertical section on an enlarged scale as seen generally along the line 15—15 of FIG. 1 illustrating typical assembly of various panels of the present invention;

FIG. 16 is a plan view of an insulated floor structure typically used over an unheated tuck-under garage portion of the structure, portions thereof broken away and shown in section;

FIG. 17 is a perspective view of a typical panel illustrated in FIG. 16;

FIG. 18 is a view in top plan thereof;

FIG. 19 is an enlarged sectional view as seen generally from the line 19—19 of FIG. 16, portions thereof broken away;

FIG. 20 is a view in vertical section as seen generally along line 20—20 of FIG. 11 illustrating passageways for electrical wiring from a wall panel to a roof panel;

FIG. 21 is a view in perspective of a roof panel having a passageway for electrical wiring; and FIG. 22 is an enlarged, detailed sectional view of a portion of FIG. 20.

DETAILED DESCRIPTION OF THE PREFERRED EMBODIMENT

Referring now to the drawings wherein like reference numerals designate identical or corresponding parts throughout the several views, and more particularly to FIG. 1, a building in the form of a house utilizing the construction of the present invention is designated generally by the numeral 30. House 30 includes footings 32 which support basement wall panels 34. First floor wall panels 36 rise above the floor 38. First floor wall panels 36 may be constructed in a variety of sizes to be described hereinafter so that various length walls may be constructed, and openings such as windows 40 and door 42 may be provided. Gable panels 44 rise above appropriate end walls and help support roof panels 46.

Figure 2B:
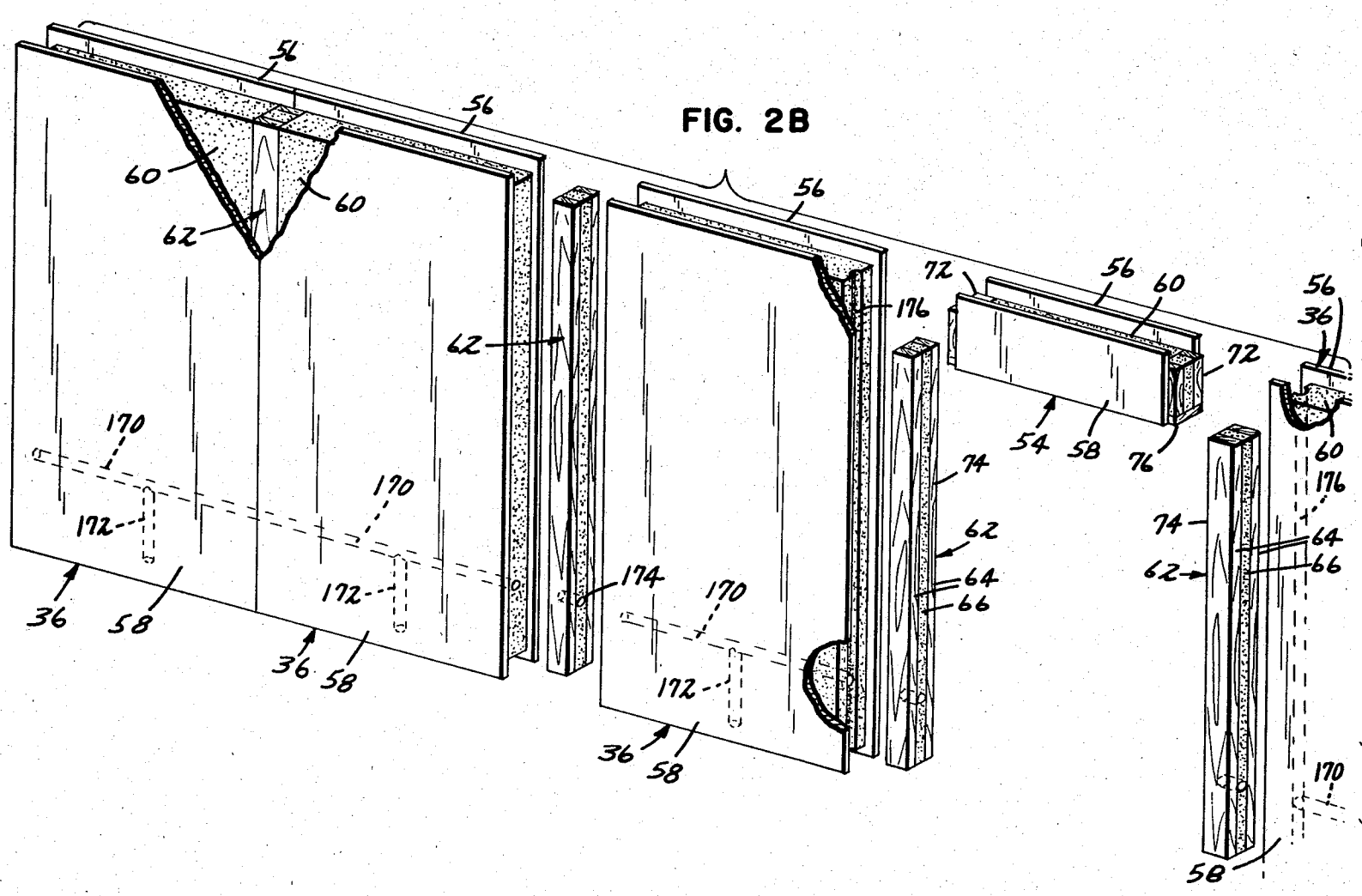
Figures 2C, 2D, 2E, 2F:
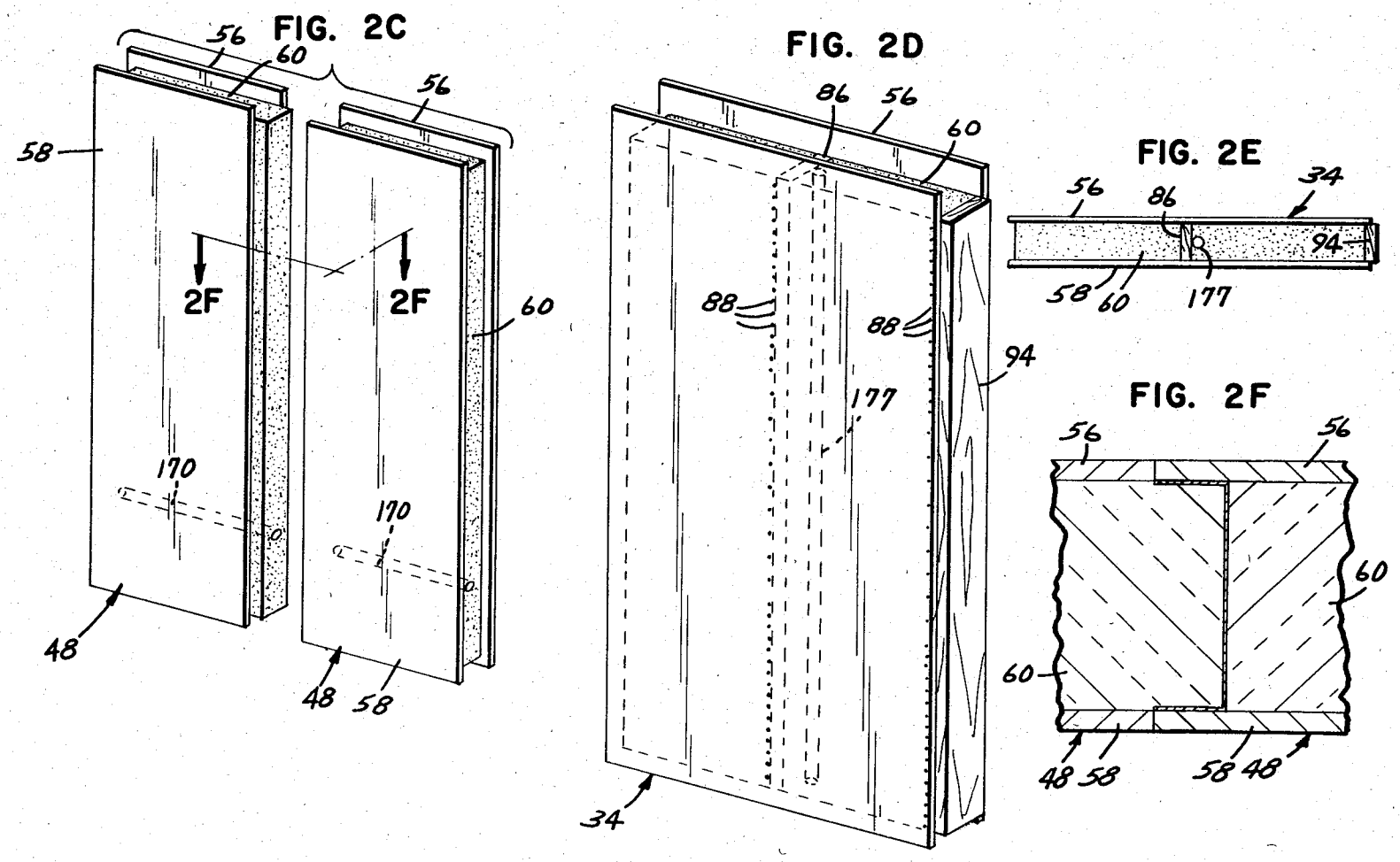

As shown in FIGS. 2*a*, 2*b* and 2*c*, wall panels and the various joining mechanisms for abutting panels typical of a first floor construction are shown. Most wall panels 36 are a standard width, commonly four feet. Smaller one or two foot panels 48 may be used as well. Other panels, such as a lower panel 50 and an upper panel 52 are used below and above a window, and panel 43 is used above a door.

Each various wall panel is constructed to include an interior skin 56, an exterior skin 58 and an insulating core 60 therebetween. The interior and exterior skins may be made form various materials, but commonly waferboard or plywood is used. Also, various insulating materials may be used for insulating core 60, but expanded polystyrene is preferable. For most wall panels, the interior skin 56 and the exterior skin 58 extend beyond the insulating core 60 along all edges. In the case of the smaller wall panels 48 (see FIGS. 2*c* and 2*f*), it is often desirable to have insulating core 60 extend beyond interior skin 56 and exterior skin 58 along at least one vertical edge. In such circumstance, an adhesive caulking see FIG. 2*f* is applied to the exposed surfaces of the extension of insulating core 60, and it is inserted into the space between interior skin 56 and exterior skin 58 to abut against the insulating core 60 of the adjacent panel 48.

A more common joint mechanism utilizes a stud post 62. Post 62 includes interior and exterior support members 64 with an insulating layer 66 therebetween. Interior and exterior support members 64 are typically wood of a type commonly used for studs in buildings while insulating layer 66 is preferably a polystyrene of a type more dense than that used in the various wall panels.

As indicated, a bearing post 62 is the usual joining member between adjacent wall panels. Considering, for example, adjacent wall panels 36, an adhesive caulking see FIG. 4*a* is preferably applied to all sides of post 62. Post 62 is then inserted into the space between the interior skin 56 and the exterior skin 58 of one of panels 36. The other panel 36 is then slid against post 62 so that post 62 is similarly received between interior skin 56 and exterior skin 58. The insulating layer 66 of post 62 is aligned with the insulating cores 60 of panels 36 and abuts the cores 60. Therefore, a continuous thermal barrier is formed across the support joint. The interior skin 56 and the exterior skin 58 of each panel 36 extends approximately one half the distance across post 62.

A post 62 is used on both sides of door spaces 42 and window spaces 40. Either the type of joint as just described for post 62 is used as shown in FIG. 2*a* with respect to panel 50 or the type of joint wherein the insulating core 60 protrudes from the interior skin 56 and the exterior skin 58 may be used as shown with respect to panel 52. In the latter case, posts 36 are necessarily shorter than when they reach to the top of a wall. Note that a frame plate 68 rests on the upper edge of core 60 in lower panel 50, and frame plate 70 is fastened beneath core 60 of upper panel 52. In this fashion, window 40 is formed by spaced apart posts 62 and lower frame plate 68 and upper frame plate 70.

Panel 54 above door 42 rests on spaced apart posts 62 in a somewhat different fashion than panel 52 for window 40. Posts 62 are cut into upper portions 72 and lower portion 74. Frame plate 76 is fastened beneath core 60 of panel 54 and extends between upper portion 72 and lower portion 74 of each post 62. Posts 62 are otherwise joined to adjoining wall panels 36 in a fashion as described hereinbefore.

Just as the various joints between two of the various wall panels whether or not a post 62 is used preserve an insulating barrier along the wall, so too does a corner joint of the present invention preserve the insulating barrier. As shown in FIGS. 2*a*, 4, and 4*a*, a corner joint is formed by the abutment of a standard panel 36 with a corner panel 78. The corner edge of insulating core 60 of panel 36 is removed to a somewhat greater depth so that the entire width of a post 62 may be received between the interior skin 56 and the exterior skin 58 of panel 36. An insulating strip or modified post 80 is fastened to the corner end of the interior skin 56 of panel 36. With panel 36 appropriately in place in its wall, corner panel 78 at the end opposite the corner may be moved into place to join in the usual fashion with a post 62 (not shown) while at the same time swinging so that insulating core 60 of panel 78 abuts a modified post 80. Modified post 80 is similar to a post 62 except it is shorter in one dimension or it may be a strip of insulating core material. Alternatively, modified post 80 could be replaced by an insulation strip. As indicated previously, adhesive caulking see FIG. 4*a* is used between abutting surfaces. The exterior skin 58 of corner panel 78 extends well beyond core 60 of panel 78 so as to cover post 62 and abut against exterior skin 58 of panel 36. Interior skin 56 of panel 78 has a removable portion 82 which when removed allows panel 78 to easily swing into place as described previously. With panel 78 in place, removable portion 82 may be placed against core 60 of panel 78 and modified post 80 and fastened thereto to completely cover them both. It is noted that modified post 80 is wider than post 62 and, therefore, an insulating barrier is formed about corner post 62 by cores 60 of panels 36 and 78 in combination with modified post 80. Modified post 80 has the same width as core 60 of corner panel 78 so that the interior surfaces of removable portion 82 and interior skin 56 of panel 78 form a plane when removable portion 82 is fastened as described.

A basement panel 34 is shown in FIG. 2*d*. Panel 34 similarly includes an interior skin 56 and an exterior skin 58 separated by an insulating core 60. Interior skin 56 and exterior skin 58 ordinarily extend beyond core 60 along all edges. A support member 86, commonly of wood, is used more frequently than is the case with supporting members for panels 36. If panels 34 are approximately four feet in width as preferred, then a support member 86 is fastened at the center of the width of panel 84. Additional support members 86 are used at the vertical edges of panel 84 and attached in a fashion similar to that described with respect to posts 62. Nails 88 are used in addition to an adhesive to fasten interior skin 56 and exterior skin 58 to the various support members 86. The spacing of nails 88 varies depending on the depth at which basement panel 84 is located beneath the surface of the ground.

FIG. 3 shows a basement construction in accordance with the present invention. Resting on footing 32 is sill plate 90. As indicated previously, interior skin 56 and exterior skin 58 of basement panel 34 extend beneath insulating core 60 and therefore fit over sill plate 90. Adhesive caulking (not shown) is applied to sill plate 90 before basement panels 34 are emplaced. Adjacent basement panels are joined at a post 94 in a fashion similar to that described with respect to post 62. Also, the corner joint is similar to that described with respect to FIG. 2*a*. Header plates 96 are fitted within the space between interior skin 56 and exterior skin 58 of basement panels 34. It is preferable that the abutting contact line of the upper set of header plates 96 is not located directly above the abutting line of the lower set of header plates 96. Interior skin 56 and exterior skin 58 of basement panels 34 extend upwardly sufficiently to be approximately flush with the upper surface of the upper set of header plates 96.

In FIG. 4, a typical first floor construction in accordance with the present invention is shown. Primary support for the construction is provided by basement wall 98 which may be constructed in accordance with the present invention as described with respect to FIG. 3 or may be of a conventional cement block or other type construction. Resting on the basement wall 98 is a header or sill plate 100. The floor joists 102 run in one direction with a cap plate 103 extending perpendicularly thereto. A sill plate 104 is attached to flooring 106 resting on joists 102. As described with respect to basement panels 34, the various first floor panels including wall panel 36 and corner panel 78 slip onto caulked sill plate 104 since the interior skins 56 and exterior skins 58 extend beneath central cores 60. The joint between the adjacent panels and the corner joint are formed as described hereinbefore. Also, header plates 108 are located and attached as described with respect to header plates 96 in FIG. 3. With respect to first floor construction, however, the lower header plate along walls on which gable panels will be supported is an insulating strip filler 110. The reason for filler 110 will become apparent hereinafter.

FIGS. 5 and 6 show the addition of gable panels 112 and 114 to an end wall 118. A further header plate 116 is attached to end wall 118 to rest on earlier attached header plate 108. Since plate 116 is needed to mate with gable panels 112 and 114, filler 110 is used to increase the height of insulation along wall 118 and to avoid a triple header thickness. The end of header plate 116 is spaced inwardly from the corner since the tip of gable panel 112 includes a pair of strips 120 and 122 forming a wedge which protects the corner of core 60 of panel 112. Thus, header plate 116 is spaced from the end of wall 118 sufficiently far so as to mate with strip 120. Although gable panel 112 is shaped in the form of a triangle and gable panel 114 in the shape of a trapezoid, panels 112 and 114 are otherwise constructed similarly to earlier described panels which include an interior skin 56, an exterior skin 58 and a core 60 therebetween. Gable panels 112 and 114 fit over header plate 116 and are joined at posts 124 and 126 in accordance with earlier described procedures.

As shown in FIG. 15 header plate 134 rests in the space between interior skin 56 and exterior skin 58 at the top of gable panels 112 and 114.

Beam support post 126 rises from first floor sill plate 104 and does not quite extend to the top of gable panels 114 which are joined by post 126. With appropriate portions cut from interior skins 56 of panels 114 (see FIG. 8), central beam 128 is then able to rest on post 126. The opposite end of beam 128 may rest on a similar post in a wall opposite wall 118, or it may rest on an interior frame 130 as shown in FIG. 5.

FIGS. 7–10 further show beam 128 and the addition of roof panels 46 to the construction. Beam 128 includes a plurality of straps 132 which are sandwiched between a pair of members which make up beam 128 (see also FIG. 13). Straps 132 extend above beam 128 and include a pattern of openings used for nail placement when attaching a roof panel 46. Alternatively, beam 128 may be the upper stringer of an interior wall. In any case, straps 132 would extend above the particular embodiment of beam 128.

Atop the panels of sidewall 136, there are fastened to header plate 108 a plurality of straps 138. To conform to the shape of the wedge formed by strips 120 and 122 of panel 112, an insulating strip 140 and a trapezoidal support member 142 are also fastened to header plate 108 to sandwich therebetween the strips 138. Insulating strip 140 functions to preserve the thermal barrier in the transition region between cores 60 of the panels in wall 136 and core 60 of the roof panels 46.

Roof panels 46, as with the other panels, have an interior skin 56 and an exterior skin 58 with an insulating core 60 therebetween. A side plate 144 is fastened along each longer edge of panel 46. Similarly, an end plate 146 (see FIG. 9) is attached to the top end of panel 46. The ends of panel 46 are generally vertical regardless of the slope of the roof. In this fashion, end plate 146 fits flush against one of straps 132 and may be nailed in place. As shown in FIG. 10, as each roof panel 46 is added to a roof, the uncovered side is toenailed with a nail 148 to beam 128. It is noted that the upper side of beam 128 slopes downwardly on each side of an apex running through straps 132. The downward slope conforms to the slope of roof panels 46. Roof panel 46 is further fastened to the building construction by nailing upwardly through straps 138 into interior skin 56 of panel 130. When all panels 130 are in place on one side of a roof, an end plate 150 (see FIG. 11) is attached along the length of the roof. As further shown in FIG. 11, each roof panel is further fastened by inserting an angle bracket 152 into slots 154 of adjacent roof panels. Slot 154 is aligned with the outer surface of the side wall 136 so that the lower portion of bracket 152 may be nailed to the side wall while the upper portion may be nailed to the top of each of the adjacent roof panels 46.

When a first roof panel 46 is emplaced, a panel 46 on the opposite side of beam 128 from the first panel is added to alleviate undue side stress on beam 128. Also, the order of consecutive panel pairs is alternated so that strap 132 is attached to a panel 46 on one side of beam 128 for one pair, and the next strap 132 is attached to a panel on the other side of beam 128 for the next pair. The upper end of roof panels 46 from the second side must be toenailed into the abutting roof panel 46 from the first side as shown in FIG. 13. Then, as shown in FIG. 12, apex straps 158 are positioned over the apex of the roof along a crack between adjoining roof panels and nailed to the four such panels 46. Note that the advantageous use of straps 132 allow the two sides of the roof to abut thereby vastly improving insulating efficiency as compared to art structures having a metal beam therebetween, for example. The various straps and brackets 132, 138, 152 and 158 attach the various roof panels 46 to each other to form a strong roof unit and, at the same time, attach the roof unit to central beam 128 and to the building sidewalls. The fastening mechanisms very simply yet with substantial fastening strength prevent any one panel or the roof unit as a whole from loosening or sailing in a wind storm.

Although not always shown, it is understood that nails are frequently used throughout the construction. For example, panels 36 are nailed to posts 62 through both the interior skin 56 and the exterior skin 58. Nails are used similarly in the basement construction, the gable construction, and other places. Nail spacing, type and coating are commonly defined and required by area building codes. It is understood, therefore, that nail fastening is designed and engineered to meet such building code requirements.

As indicated previously, a building in accordance with the present construction may utilize a conventional floor or, floor panels 160, recommended especially for over crawl spaces and unheated garages. As shown in FIGS. 16–19, a floor panel is substantially the same as a basement wall panel in that it includes skins 56 and 58 with an insulating core 60 therebetween and a support member 86 centered between the longer edges of core 60. An additional support member 86 is used between adjacent panels 160 in a fashion similar to the joints between adjacent basement panels 84. Floor panels 160 are supported on header plates 100 as described with respect to FIG. 4 and if the span is too long for a panel 160 to extend from one side of the building to the other, then a central support 162 is provided. Cap plates 103 are fastened perpendicular to support members 86. An interior connecting plate 163 is fastened between facing floor panels 160.

In addition to minimizing "thermal shorts" with the hereinbefore described features, the present invention further includes an advantageous mechanism for wiring a building. As shown in FIG. *2a*, each first floor panel such as 36, 48, 50 and 78 includes a first passageway 170 which extends horizontally between opposite side edges of core 60 of each such panel. Passageway 170 is centered in the thickness of core 60. Passageway 170 is located at approximately the bottom of conventional electrical outlet boxes which have a minimum height above the floor as usually required by building codes. A second passageway 172 rises vertically from the lower edge of core 60 to first passageway 170. Passageway 172 is centered in the thickness of and between the side edges of core 60. All passageways are one inch in diameter or larger and are, therefore, large enough to route several electrical wires therethrough.

Post 62 similarly has a passageway 174 at the same distance from the bottom of post 62 as passageway 170 is from the bottom of core 60. Therefore, passageways 170 align with passageways 174 and electrical wire may be routed along an entire wall.

As shown in FIG. *4a*, passageways 170 do not meet at the corner of two walls. Even if they did, it would be difficult to bend stiff electrical wire around such a corner. Consequently, it is preferable for electrical wiring to pass downwardly through a passageway 172 and through an opening in the floor for routing along the underside of the floor to a passageway 172 on the adjacent wall.

As shown in FIG. *2b* in panels 36 adjacent to door 42, it is preferable to include grooves 176 in the vertical edge of core 60 of panels 36 which abut posts 62 forming a part of the frame of door 42. Groove 176 extends from top to bottom of core 60. In this fashion, electrical wiring may be routed upwardly to a switch box commonly located several feet above the floor near a door as well as upwardly to the ceiling. Basement panels 34 have vertical passageways 177 (see FIG. *2d*), too, but they are located next to the support member 86 located centrally in panels 34.

As shown in FIGS. 20 and 21, openings 178, 180 and 182 are bored through header plates 108 and insulating strip 140 to match with a groove formed along the edge of core 60 of roof panel 46. Passageway 184 has a vertical portion half the distance of the thickness of a wall panel 36 from slot 154. Passageway 184 then extends along the edge of core 60 to approximately the center of what is to be the interior ceiling of the building. In many cases, it may be preferable to extend passageway 184 the entire length of panel 46. Depending on where a light is to be located and hung from panel 46, a further passageway 186 may be bored horizontally in core 60 as shown in FIG. 21.

As shown in FIG. 22, rather than form a passageway horizontally or vertically in insulating strip 140, it is sometimes preferable to simply space apart insulating strip 140 from supporting member 142 to provide a further passage 188 for electrical wiring.

In use, various panels such as 36, 50, 52, 54, 78, 84, 112, 114, 130 and possibly others in addition to posts 62 and beam 128 and possibly other components are constructed at a manufacturing site and thereafter transported to a construction site. As shown in FIG. 15, a basement is constructed firstly by pouring the various footings 32 and installing sill plate 90. In a basement wherein basement panels 34 in accordance with the present invention are used, such panels 84 are then emplaced using the joining mechanisms including adhesive caulking and nails as described hereinbefore. The cement slab 194 is then poured to fill in against panels 84. In this fashion slab 194 holds panels 34 against the force of outside dirt.

Header plates 96 are fastened in place, and a floor 38 is installed. Floor 38 may be of the conventional type which is actually preferable when the basement is insulated with panels 84 or floor 38 may be formed from floor panels 160 in accordance with the present invention. In any case, a first floor sill plate 104 is attached to floor 38. The various first floor wall panels such as 36, 48, 50, 52, 54 and 78 are emplaced and joined as described hereinbefore thereby creating walls 118, 136. Header plates 108 and insulating strip 110 are then fastened in place and gable panels 112 and 114 installed and joined as described hereinbefore. The roof is fastened in place using beam 128 and triangular insulating strip 140 and supporting member 142 to support roof panels 46. Various miscellaneous members and fastening devices are attached as appropriate and the building completed in a usual fashion.

The various panels of the present invention offer the usual advantages of prefabrication as compared to conventional construction methods. Distinctly advantageous, however, are the mechanisms for eliminating "thermal shorts" along the various walls and corners as well as between the walls and roof and between the two sides of the roof. Additionally, such thermal efficiency is possible and maintainable while yet providing for efficient electrical wiring of the building. Furthermore, since the wall panels are limited in width, they may be handled by workers without the need for a crane or other mechanized lifting tool. Consequently, building costs are minimized and a truly thermally efficient building results.

Thus, a preferred embodiment of the present invention has been set forth with particularity. Despite the numerous characteristics and advantages of this invention set forth, together with detail of structure and function, however, it is to be understood that the present disclosure is illustrative only. Changes made, especially in matters of shape, size and arrangement, to the full extent extended by the general meaning of the terms in which the appended claims are expressed, are fully contemplated to be within the principle of this invention.

What is claimed is:

1. The combination comprising:

first and second walls;

first means for joining said first and second walls;

one of said first and second walls including first and second panels each having:

an interior skin;

an exterior skin; and an insulating core fastened between said interior and exterior skins, said interior skin, said exterior skin and said core all having vertical edges, the vertical edges of said interior skin and said exterior skin extending in a horizontal direction beyond the vertical edges of said core at one end to form a first groove at such end of each of said first and second panels; and means for connecting said first and second panels together, said connecting means including first, second and third posts with interior and exterior support members and an insulating layer therebetween, said first post being fastened in said first grooves to said first panel and to said second panel with said insulating layer in said first post aligned with said insulating core of said panels to provide connection with continuous thermal insulation across said first post between said panels;

said first panel receiving said second post between said exterior and interior skins, said second and third posts being shorter than said first panel, said second and third posts being spaced apart, said second panel having a first frame plate fastened beneath said core, said first frame plate resting on said second and third posts such that said first and second panels rise to a similar height, whereby said second and third posts and said first frame plate of said second panel form a frame for an opening.

2. The combination in accordance with claim 1 including a third panel having interior and exterior skins with a core therebetween, said skins extending beyond said core along opposite vertical edges, said second and third posts being spaced apart by said third panel, said third panel having an upper edge and a second frame plate fastened thereto, said second frame plate being spaced from said first frame plate of said second panel to further define a frame for said opening.

3. The combination comprising:

first and second walls;

first means for joining said first and second walls;

one of said first and second walls including first and second panels each having:

an interior skin;

an exterior skin; and an insulating core fastened between said interior and exterior skins, said interior skin, said exterior skin extending beyond said core; and means for connecting said first and second panels together, the core of said second panel having a lower edge and including a first frame plate attached to said lower edge, said connecting means including first and second posts with interior and exterior support members with an insulating layer therebetween, said first and second posts being spaced apart, said first and second posts being cut into upper and lower portions, said upper and lower portions being separated by said first frame plate, the lower portion of said first post being received and fastened between the interior and exterior skins of said first panel, the upper portion of said first post being received and fastened between said skins of said first and second panels, the upper portion of said second post being received and fastened between the skins of said second panel with the insulating layer in the upper portion of said first post being aligned with said insulating core of said panels whereby the lower portions of said first and second posts and said first frame plate of said second panel form a frame for an opening.

4. The combination in accordance with claim 3 wherein said first panel has a first passageway in the insulating core extending between opposite first and second vertical edges and wherein said first post in the insulating layer has a second passageway aligned with the first passageway of said first panel whereby said passageways are available for routing electrical wiring.

5. The combination in accordance with claim 4 wherein said core of said panel includes a third passageway extending between a third edge of said core to said first passageway.

6. The combination in accordance with claim 3 including a third panel having interior and exterior skins with a core therebetween, said skins extending beyond said core along opposite vertical edges, said second and third posts being spaced apart by said third panel therebetween, said third panel having an upper edge and a second frame plate fastened thereto, said second frame plate being spaced from said first frame plate of said second panel to further define a frame for said opening.

7. The combination comprising:

a first wall having a first panel and a second wall having a second panel, said panels resting on deck means provided with a mounting sill plate, said panels including an interior skin and an exterior skin with an insulating core therebetween, the interior skin of said second panel having a removable portion, said interior skins of said first and second panels having surfaces in contact with said cores which form first and second planes, said skins having bottom edge portions extending beyond said core to fit over said sill plate; and means for joining said first and second panels at a corner of said first and second walls, said joining means including means for bearing a roof member, said bearing means being fastened between said interior and said exterior skins of said first panel at a first end of said first panel, said joining means further including an insulating strip fastened to said interior skin of said first panel adjacent to the first end, said core of said second panel butting against said strip, said exterior skin of said second panel extending beyond the core of said second panel to cover said bearing means and meet said exterior skin of said first panel, said removable portion of said interior skin of said second panel fitting over said insulating strip along the second plane of said interior skin of said second panel whereby the removable portion of said interior skin of said second panel meets said interior skin of said first panel.

8. The combination in accordance with claim 7 including header means for attaching a roof, said header means including first and second sets of first and second header plates resting on said cores of said panels between said interior and said exterior skins, said first set of header plates butting against one another approximately along said first plane and said second set butting against one another approximately along said second plane.

9. A building structure for minimizing thermal shorts comprising:

a plurality of walls including insulated wall panels and bearing means for structurally supporting a load, said plurality of walls including an end wall, said end wall having wall panels along a lower portion and gable panels along an upper portion, said gable panels including an adjacent pair having top edges rising to a peak, said bearing means including a plurality of posts with interior and exterior support members and an insulating layer therebetween;

first means for joining a first wall panel to a second wall panel;

second means for joining a first wall to a second wall;

a floor having a sill plate thereon for supporting said walls;

header means for providing structural support above said walls and between said wall panels and said gable panels;

a substantially horizontal beam supported by said bearing means, said beam spanning space from said end wall toward another wall, said bearing means including a longer post, said longer post connecting together a pair of adjacent said wall panels and said adjacent pair of gable panels in said end wall, said longer post rising from said sill plate to said beam to support one end of said beam;

means for supporting a second end of said beam;

a plurality of insulated roof panels supported by said beam and said header means; and means for fastening said roof panels to form a roof attached to said walls and said beam.

10. A building structure in accordance with claim 9 wherein said adjacent pair of gable panels have cutout portions near the peak to form a socket for receiving said beam, said beam having upper inclined sides, whereby said beam cooperates with header means above said gable panels to receive and support said roof panels thereon.

11. A building structure in accordance with claim 9 including a wedge-shaped insulating strip attached between said header means above at least one of said walls and the roof panels supported by said one wall.

12. A building structure for minimizing thermal shorts comprising:

a plurality of walls including insulated wall panels and bearing means for structurally supporting a roof;

first means for joining a first wall panel to a second wall panel;

second means for joining a first wall to a second wall;

a floor having a sill plate thereon for supporting said walls;

a substantially horizontal beam supported by said bearing means, said beam spanning space between said walls, said beam having an upper side with an apex and third and fourth walls sloping downwardly away from said apex, said beam including a plurality of spaced apart first straps rising substantially vertically from approximately said apex;

header means for providing structural support above said walls;

a plurality of insulated roof panels supported by said beam and said header means to form a roof, one of a pair of said panels abutting each other above said beam being fastened to one of said straps, whereby consecutive pairs of said panels form said roof with substantially a continuous thermal barrier thereacross; and means for fastening each of said roof panels to an adjacent roof panel and to one of said walls.

13. The structure in accordance with claim 12, wherein said fastening means for each of said roof panels includes a second strap fastened to said header means and to said roof panel to attach said roof to said walls.

14. The structure in accordance with claim 12 wherein said fastening means includes an angle bracket extending through slots in adjacent said roof panels for fastening to an upper surface of each of said adjacent roof panels and for fastening beneath said roof panels to one of said walls.

15. The structure in accordance with claim 12 wherein said fastening means includes one of said pair of abutting roof panels being toenailed with a plurality of nails to the other, both of said pair of panels being toenailed to said beam.

16. The structure in accordance with claim 12 wherein said fastening means includes a second strap for fitting across said pair of abutting roof panels over said apex, said second strap being fastened to said panels with a plurality of nails.

* * * * *

UNITED STATES PATENT AND TRADEMARK OFFICE

CERTIFICATE OF CORRECTION

PATENT NO. : 4,578,909

DATED : April 1, 1986

INVENTOR(S) : Harold B. Henley et al

It is certified that error appears in the above-identified patent and that said Letters Patent is hereby corrected as shown below:

Column 5, line 25, "see Fig. 2f" should be --(see Fig. 2f)--.

Column 5, line 40, "see Fig. 4a" should be --(see Fig. 4a)--.

Column 5, line 26, "see Fig. 4a" should be --(see Fig. 4a)--.

Column 10, line 24, delete "84" and insert therefor --34--.

Signed and Sealed this

Twentieth Day of October, 1987

*Attest:*

DONALD J. QUIGG

*Attesting Officer*

*Commissioner of Patents and Trademarks*